US009879660B2

(12) United States Patent
Bowen

(10) Patent No.: US 9,879,660 B2
(45) Date of Patent: Jan. 30, 2018

(54) PUMP FOR REMOVING LIQUIDS FROM VESSELS UNDER VACUUM

(71) Applicant: Galen Michael Bowen, Ukiah, CA (US)

(72) Inventor: Galen Michael Bowen, Ukiah, CA (US)

(73) Assignee: Springboard Biodiesel, LLC, Chico, CA (US)

( * ) Notice: Subject to any disclaimer, the term of this patent is extended or adjusted under 35 U.S.C. 154(b) by 406 days.

(21) Appl. No.: 14/745,415

(22) Filed: Jun. 20, 2015

(65) Prior Publication Data

US 2015/0377231 A1 Dec. 31, 2015

Related U.S. Application Data

(60) Provisional application No. 62/017,284, filed on Jun. 26, 2014.

(51) Int. Cl.

| | |
|---|---|
| ***F04B 9/123*** | (2006.01) |
| ***F04B 49/04*** | (2006.01) |
| ***F04B 53/14*** | (2006.01) |
| ***F04B 53/16*** | (2006.01) |
| ***F04B 53/10*** | (2006.01) |
| ***F04B 39/10*** | (2006.01) |
| ***F04B 9/125*** | (2006.01) |
| ***F04B 49/22*** | (2006.01) |

(52) U.S. Cl.

CPC ..... *F04B 9/123* (2013.01); *F04B 9/1253* (2013.01); *F04B 39/10* (2013.01); *F04B 49/04* (2013.01); *F04B 49/22* (2013.01); *F04B 53/10* (2013.01); *F04B 53/1035* (2013.01); *F04B 53/14* (2013.01); *F04B 53/16* (2013.01)

(58) Field of Classification Search

CPC ..... F04B 49/04; F04B 53/10; F04B 39/10; F04B 53/101; F04B 53/1035; F04B 9/123; F04B 9/125; F04B 9/127; F04B 9/1273; F04B 9/1253; F04B 53/16

See application file for complete search history.

(56) References Cited

U.S. PATENT DOCUMENTS 1,097,531 A * 5/1914 Cann ..... F04B 9/127 417/380

1,412,863 A * 4/1922 Hancock ..... F04B 53/1037 137/242

(Continued)

*Primary Examiner* — Bryan Lettman

(57) ABSTRACT

A pump moves fluid by a piston reciprocating inside a cylinder. Fluid enters the cylinder through an inlet valve that passes through the cylinder head, and has an enlarged surface inside the cylinder, which seals against the cylinder head. This valve is normally held closed by a spring. As the piston advances, fluid is forced out of the cylinder through a passage in the cylinder head and a check valve. A rod is affixed to the piston and passes through the inlet valve. As the piston retracts, the rod slides through the inlet valve, until a stop, affixed to the rod, encounters the stem of the inlet valve. The spring holding the valve closed is overcome and the valve opens as the piston and rod move farther, until the piston is in its fully retracted position. Fluid enters the cylinder until the piston again begins to advance. The stop ceases to push the inlet valve open, and the spring again holds it closed.

10 Claims, 4 Drawing Sheets

(56) References Cited

U.S. PATENT DOCUMENTS 1,676,186 A * 7/1928 Hawkins ..... F04B 53/10 417/444
1,839,611 A * 1/1932 Stafford ..... F01L 23/00 417/402
1,880,650 A * 10/1932 Zagst ..... F01L 23/00 417/399
2,984,225 A * 5/1961 Young ..... F01L 23/00 417/399
2,987,047 A * 6/1961 Young ..... F01L 23/00 417/398
3,033,123 A * 5/1962 Kinzelman ..... E04F 21/08 417/264
3,218,980 A * 11/1965 Arnes ..... F01L 25/063 417/375
3,362,618 A * 1/1968 Fortinov ..... F04B 9/127 417/401
3,986,355 A * 10/1976 Klaeger ..... F01L 25/063 417/904
4,026,439 A * 5/1977 Cocks ..... B01F 15/0454 222/49
5,071,325 A * 12/1991 Tupper ..... F02M 1/16 137/556
5,150,643 A * 9/1992 Saita ..... F01L 23/00 91/229
5,188,518 A * 2/1993 Saita ..... F01L 21/04 417/403
6,123,008 A * 9/2000 Scherer ..... F01B 11/001 91/306
6,357,235 B1 * 3/2002 Cerro ..... F01K 19/02 60/645
6,497,562 B1 * 12/2002 Greiff ..... B60T 8/368 417/560
2008/0014101 A1 * 1/2008 Hartung ..... B41F 31/02 417/384
2009/0026220 A1 * 1/2009 Ramnarine ..... F04B 9/125 222/1
2014/0127036 A1 * 5/2014 Buckley ..... F04B 53/10 417/53
2014/0127058 A1 * 5/2014 Buckley ..... F04B 39/10 417/415
2014/0127062 A1 * 5/2014 Buckley ..... F04B 53/10 417/439
2016/0032911 A1 * 2/2016 McCoy ..... F04B 35/008 417/460
2016/0201656 A1 * 7/2016 Suita ..... F04B 9/127 417/392

* cited by examiner

PUMP FOR REMOVING LIQUIDS FROM VESSELS UNDER VACUUM

CROSS REFERENCE TO RELATED APPLICATIONS

This patent application claims the priority of U.S. Provisional Patent Application No. 62/017284 entitled "PUMP FOR REMOVING LIQUIDS FROM VESSELS UNDER VACUUM" filed Jun. 26, 2014, which is herein incorporated by reference.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

REFERENCE TO SEQUENCE LISTING, A TABLE, OR A COMPUTER PROGRAM LISTING COMPACT DISC APPENDIX

Not Applicable

STATEMENT REGARDING PRIOR DISCLOSURES BY THE INVENTOR OR A JOINT INVENTOR

Not Applicable

BACKGROUND OF THE INVENTION

1. Field of Invention

The invention relates to positive displacement pumps, and particularly to pump inlet valves.

2. Description of Related Art

Many industrial processes involve separation of liquid and vapor. One very common means of separation uses a knockout pot to capture entrained liquid while allowing vapor to flow out the top. The liquid pools at the bottom of the knockout pot, and eventually must be removed after it accumulates. The removal of this liquid can be difficult when the separation process takes place under vacuum. If the liquid does not have enough sub-cooling, there may be inadequate net positive suction head to avoid cavitation in a pump used to evacuate the knockout pot. Some styles of positive displacement pumps, such as piston pumps, may successfully overcome this.

Further difficulties arise, though, if very deep vacuum is employed. In these situations, the inlet check valve of a positive displacement pump may not open, because even if a full vacuum is developed inside the pump's fluid chamber, for example, in the cylinder of a piston pump, there may be little or no differential pressure across the check valve to open it. One common way to address this is by locating the pump a significant distance below the knockout pot, so that a column of fluid exists at the inlet check valve, providing enough pressure to open the check valve when sufficient vacuum exists inside the pump's fluid chamber. This method, though, may be inconvenient due to the physical space required, and it still may result in diminished flow rates, since the pump's fluid chamber may not fill completely before the check valve again closes. Also, in the event that any air enters the system by running the pump dry or during maintenance, it may be very difficult to purge this air from the system, as it may simply expand and contract as the pump operates.

U.S. Pat. No. 5,810,570 by Nguyen teaches a reciprocating piston pump with a spring-loaded magnetic inlet check valve that is unseated by a magnet located in the piston when the piston is close to its top dead center position. There remains significant room for improvement over the art taught in this patent, though, as the volumetric efficiency of such a pump is inherently limited, the inlet check valve only being open when the piston is in close proximity.

Other solutions involve secondary chambers into which effluent may drain from the main knockout pot. These chambers may be temporarily isolated from the knockout pot by closing a valve, relieved of vacuum with another valve, and emptied through yet another valve connecting the chamber to an evacuation pump. After the chamber is emptied, vacuum may be reestablished in the chamber by connection to a vacuum source, and the chamber may be rejoined to the knockdown pot by reopening the valve between them. While effective, this solution is complex.

In view of the forgoing, an improved pump design is needed, in which the inlet check valve can be simply opened at appropriate times during the pumping cycle without relying on a pressure differential, and while achieving a high volumetric efficiency.

SUMMARY OF INVENTION

The invention teaches a positive displacement pump that uses a cylinder and reciprocating piston. One end of the cylinder is affixed to a cylinder head, through which an inlet valve passes. When the piston retracts, it pulls the inlet valve open by means of a pull rod, which passes through the inlet valve. When the piston advances to force the liquid out of the cylinder, the pull rod stops holding the inlet valve open, and a spring holds it closed instead. Liquid is forced out through a passage in the head block and through an outlet check valve.

BRIEF DESCRIPTION OF THE DRAWINGS

The invention will be readily understood by the following detailed description in conjunction with the accompanying drawings, wherein like reference numerals designate like structural elements, and in which:

FIG. 2 depicts the inlet valve in the closed position. In FIG. 2, for clarity, air cylinder 102 and its associated elements as well as level sensor 117 are not sectioned.

FIG. 4 depicts the inlet valve in the open position. In FIG. 4, for the sake of clarity, air cylinder 102 and its associated elements, level sensor 117, piston assembly 103, and pull rod 104 are not sectioned.

In FIG. 6, components of the invention are hidden that obscure the view of the inlet valve and the components related to its actuation.

DETAILED DESCRIPTION OF THE PREFERRED EMBODIMENT OF THE INVENTION

Figure 1:
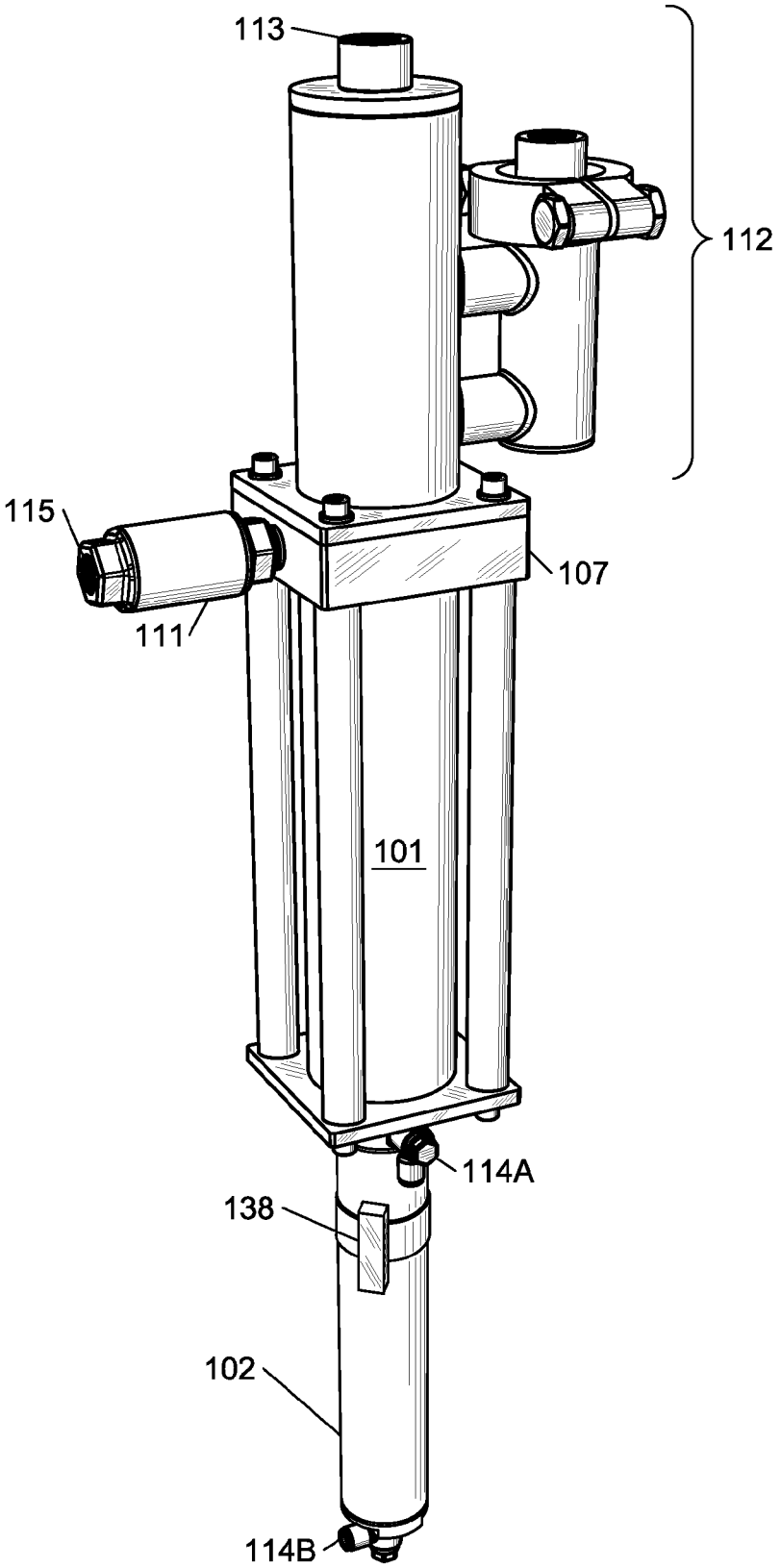
FIG. 1 is a perspective view of the invention, in accordance with one possible embodiment.

The invention is directed at a positive displacement pump utilizing a cylinder and reciprocating piston. FIG. 1 shows the fully assembled pump, according to one possible embodiment. Cylinder 101 houses a reciprocating piston. The piston may be actuated by a wide range of suitable means. Some examples of means of piston actuation might include a pneumatic linear actuator, electric linear actuator, or a rotary crank and connecting rod mechanism. In the preferred embodiment, a pneumatic linear actuator, air cylinder 102, is employed.

Liquid intake section 112 is affixed and sealed to cylinder head 107. Liquid intake section 112 includes liquid intake port 113, which may be fluidly coupled to the drainage port of a knockdown pot. Check valve 111, which, in the embodiment shown, includes liquid exit port 115, may be fluidly coupled to a receiving vessel for the effluent being pumped. In the embodiment shown, check valve 111 is a single, integrated, spring-loaded unit, affixed to cylinder head 107, but the specific style of check valve used here is not of great importance to the invention. Air inlet ports 114A and 114B are fluidly coupled to an external pneumatic control system. When compressed air is supplied to air inlet port 114A while air inlet port 114B is allowed to exhaust, air cylinder 102 retracts. When compressed air is supplied to air inlet port 114B while air inlet port 114A is allowed to exhaust, air cylinder 102 advances. The pneumatic control system used to supply compressed air to ports 114A and 114B is of a type commonly employed by pneumatic actuators and is beyond the scope of the invention disclosed herein.

Figure 2:
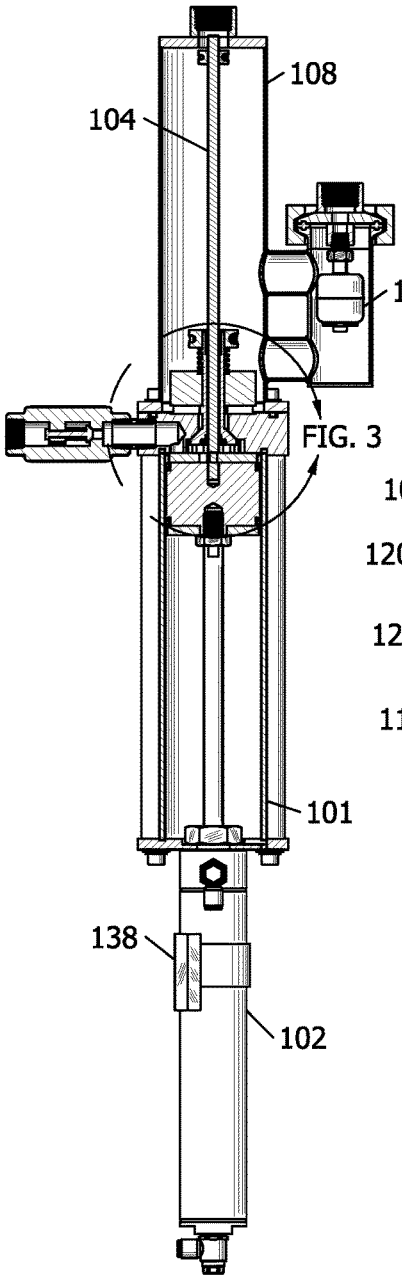
FIG. 2 is a section view of the invention, through the invention's primary plane of symmetry, according to one possible embodiment.
Figure 3:
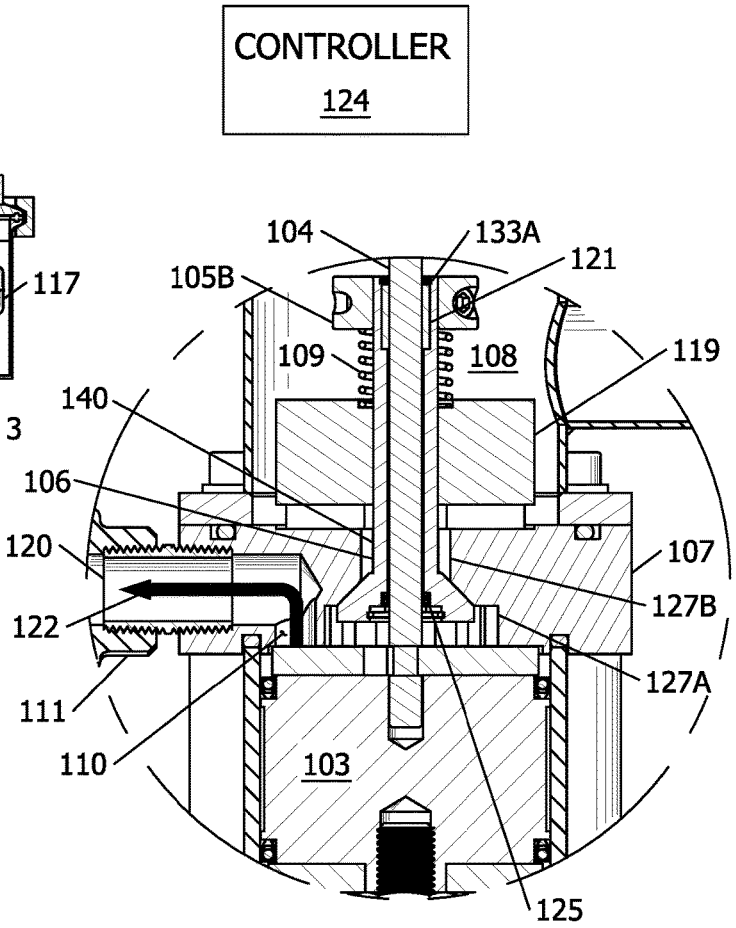
FIG. 3 is an enlarged detail of a portion of FIG. 2, showing more clearly the area surrounding the inlet valve, as well as the path of liquid exiting the pump cylinder.
Figure 4:
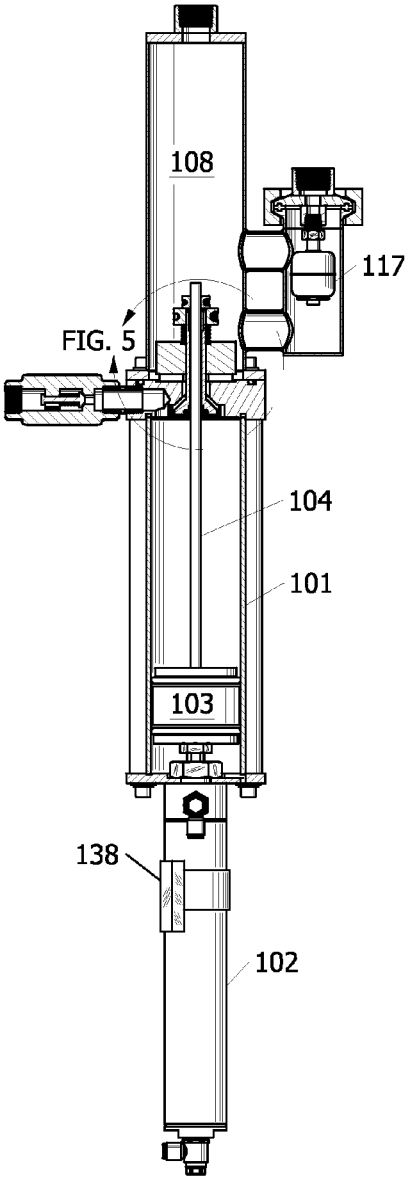
FIG. 4 is a section view of the invention, through the invention's primary plane of symmetry, according to one possible embodiment.
Figure 5:
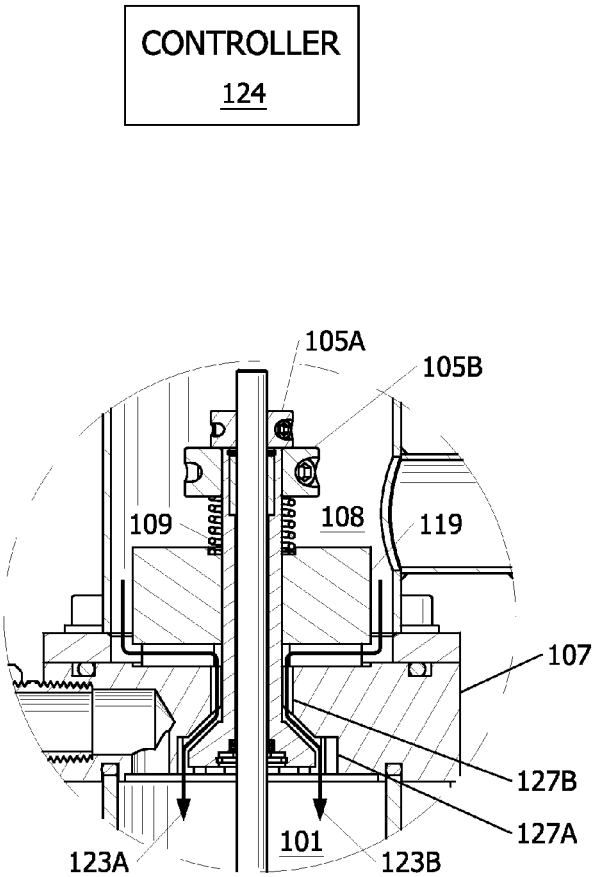
FIG. 5 is an enlarged detail of a portion of FIG. 4, showing more clearly the area surrounding the inlet valve, as well as the path of liquid entering the pump cylinder.

FIGS. 2 and 3 depict the pump with air cylinder 102 extended. FIGS. 3 and 4 depict the pump with air cylinder 102 retracted. Piston assembly 103 is affixed to the end of the extended rod of air cylinder 102. Pull rod 104 is affixed to piston assembly 103, and passes through inlet valve 106, which has a valve bore 140 through its length. When piston assembly 103 is in the fully retracted position, as can be seen in FIG. 5, stop 105A, affixed to pull rod 104, pushes axially against the stem of inlet valve 106, causing it to move axially through valve bore 140 and separate from its seat in cylinder head 107. This allows liquid to pass from drain chamber 108 into cylinder 101. As piston assembly 103 advances and leaves the fully retracted position, pull rod 104 slides through inlet valve 106 and stop 105A no longer forces inlet valve 106 open. Compression spring 109, exerting a force on stop 105B, which is affixed to inlet valve 106, closes inlet valve 106, isolating cylinder 101 from drain chamber 108, as can be seen in FIG. 3. As piston assembly 103 continues to advance, liquid is forced through discharge port 110 in cylinder head 107, and then out through check valve 111.

Level sensor 117 is situated in liquid intake section 112 and is in fluid communication with liquid chamber 108. In the embodiment shown, level sensor 117 is a float switch, although other suitable means of level sensing may be used. Once enough liquid accumulates in drain chamber 108, the bulb of level sensor 117 will float, causing the state of level sensor 117 to change (either opening or closing the switch). This switching may be used as input to controller 124, which determines when to advance air cylinder 102.

Position sensor 138 is a means of sensing when the means of actuating piston 103 is in the extended position, as shown in FIG. 2. In the embodiment shown, where the means of actuating piston 103 is air cylinder 102, position sensor 138 may take the form of a common magnetic switch, the state of which changes when air cylinder 103 is in its extended position. This switching may be used as input to controller 124, which determines when to retract air cylinder 102. Other means of actuating piston 103, such as certain electric linear actuators, may have built into them a means of sensing when the actuator is in the extended position. It is also possible to eliminate position sensor 138 altogether by programming controller 124 to allow an appropriate time interval, sufficient for piston 103 to be fully advanced by whatever means of actuation is used, before it starts to be retracted.

Valve slide block 119 has a smooth bore made from a low-friction material through which inlet valve 106 slides. When piston 103 is not fully retracted, as in FIG. 3., the force created by compression spring 109 between stop 105B and valve slide block 119 pushes the tapered surface of inlet valve 106 against the like tapered surface of cylinder head 107, creating a seal between the two components. A tapered seat is only one possible means for sealing inlet valve 106 against cylinder head 107. In another embodiment, by way of example, a flat seat and a means of gasketing, such as an o-ring, might be employed to create a seal between inlet valve 106 and cylinder head 107. Plain bearing 121 provides a suitable smooth surface to support pull rod 104 as it travels through inlet valve 106. In the embodiment shown, plain bearing 121 is held axially by retaining ring 133A. Shaft seal 125 prevents leakage through the bore through inlet valve 106 through which connecting rod 104 passes.

As piston assembly 103 moves toward cylinder head 107, fluid that had been present in cylinder 101 is forced out, along fluid path 122. In the embodiment shown, fluid path 122 begins in cylinder 101, continues through discharge port 110 in cylinder head 107, and then exits through plumbing 120 and check valve 111. Depending on the nature of check valve 111, plumbing 120 may take a variety of forms or may not exist at all. In the embodiment shown, it is a pipe nipple.

In FIG. 4, air cylinder 102 is fully retracted, moving piston assembly 103 into its fully retracted position as well. This leaves the maximum possible volume available in cylinder 101 for liquid to enter. Inlet valve 106 is also open, allowing fluid to flow from drain chamber 108 into cylinder 101. In the embodiment shown, level sensor 117 is located near cylinder head 107. In such a configuration, piston assembly 103 will normally remain in the fully retracted position, and inlet valve 106 will normally remain open. Liquid entering drain chamber 108 will continue to drain into cylinder 101 until it fills completely, after which drain chamber 108 will also begin to fill. Once this fluid reaches and actuates level sensor 117, controller 124 will cause air cylinder 102 to actuate, advancing piston assembly 103 and emptying cylinder 101. It will then immediately retract again, allowing fluid to once again enter from drain chamber 108.

FIG. 5 is an enlarged view of the portion of the invention surrounding inlet valve 106. Stop 105A, which is rigidly affixed to pull rod 104, is forced against the stem of inlet valve 106 by the retraction of piston assembly 103. Stop 105B, which is rigidly affixed to inlet valve 106, compresses compression spring 109 and causes inlet valve 106 to move through valve slide block 119 and separate its tapered section from its tapered seat in cylinder head 107.

The movement of inlet valve 106 creates fluid path 123 between drain chamber 108 and cylinder 101. Liquid in drain chamber 108 flows into cylinder 101 through reliefs cut in the bottom surface of valve slide block 119, and then through one or more drain passages 127 in valve bore 140, adjacent to inlet valve 106. The shape of fluid path 123 reveals that when the pump is oriented as depicted, it may effectively self-bleed any air or other gases that may enter, perhaps as a result of loss of vacuum in the knockdown pot, running the pump dry, or maintenance. These gases may travel along fluid path 123 in the opposite direction as the liquid, from cylinder 101 to drain chamber 108, and then continue up through intake port 113 and into the knockdown pot, where they may be drawn out along with other gases. As long as the pump is installed in a vertical orientation, with intake port 113 at the top, there are no points at which significant quantities of gas may be trapped. Additionally, any gas that might remain in cylinder 101 as piston assembly 103 begins to advance will be purged out through fluid path 122.

Figure 6:
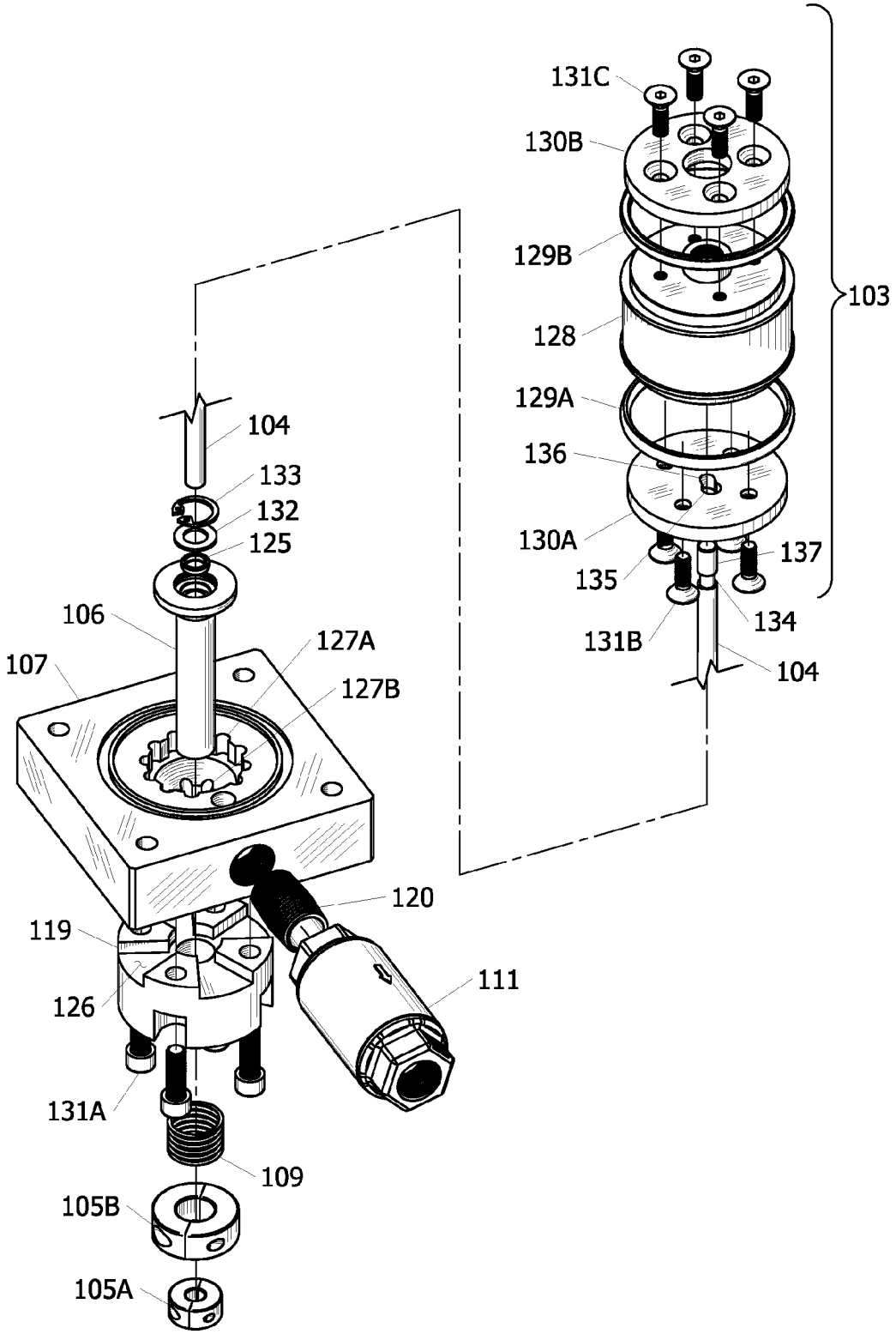
FIG. 6 is an exploded view of a portion of the invention, according to one possible embodiment.

FIG. 6 is an exploded view of the primary components involved in the operation of inlet valve 106, according to one possible embodiment. Other components that might obstruct a clear view are hidden. Valve slide block 119, which in this embodiment is affixed to cylinder head 107 by means of fasteners 131A, has reliefs 126, which provide space for liquid to flow. Cylinder head 107 also has drain passages 127, which provide space between cylinder head 107 and inlet valve 106 for liquid to freely flow.

Inlet valve 106 holds shaft seal 125, which prevents leakage of fluid around pull rod 104 as it passes through inlet valve 106. Shaft seal 125 may be any suitable means of creating a seal between pull rod 104 and inlet valve 106 while still allowing pull rod 104 to slide axially through the bore through inlet valve 106. In the preferred embodiment, it is a common spring-energized seal made from PTFE or another low-friction material with good wear resistance. Shaft seal 125 is held in place by washer 132 and retaining ring 133B.

In the embodiment shown, piston assembly 103 comprises piston body 128, plunger seals 129, seal retainer plates 130, fasteners 131B and 131C, and pull rod 104. Pull rod 104 is affixed axially to seal retainer plate 130A. In this embodiment pull rod 104 includes groove 134. The length of groove 134 is just longer than the thickness of seal retainer plate 130A. Seal retainer plate 130A has bore 135 which is offset slightly from its center axis, and is large enough for pull rod 104 to pass through. Adjacent to bore 135 is reduced bore 136, which is smaller in diameter than pull rod 104, but is just larger in diameter than groove 134. Reduced bore 136 is concentric with the center axis of seal retainer plate 130A. Pull rod 104 may be inserted through bore 135 until groove 134 and reduced bore 136 are directly adjacent to one another, then shifted laterally until pull rod 104 is concentric with seal retainer plate 130A, preventing any axial movement of pull rod 104 with respect to seal retainer plate 130A. Piston body 128 has a bore in its center just large enough to accept pull rod 104. When seal retainer plate 130A is fastened to piston body 128, end section 137 of pull rod 104 slides into the bore in piston body 128, preventing any lateral movement that might cause groove 134 to disengage with reduced bore 136. The position of end section 137 of pull rod 104 in piston body 128 is visible in FIG. 3.

The embodiment shown has a very high volumetric efficiency, easily exceeding 95% if the stroke of air cylinder 102 is long enough. Since piston assembly 103 is normally held in the fully retracted position, and inlet valve 106 is normally held in the open position, during normal operation the entire working volume of cylinder 101 will fill with liquid. Piston assembly 103 need only advance slightly before inlet valve 106 closes. During this slight movement, a small quantity of liquid will be pushed back through the space around inlet valve 106 and into drain chamber 108 until inlet valve 106 is closed. This small quantity of liquid accounts for the volumetric inefficiency of the pump. After valve 106 closes, all of the remaining liquid displaced by piston assembly 103 as it advances will be discharged through fluid path 122. Unless air cylinder 102 has an extremely short stroke length, over the course of one stroke cycle, the volume of liquid forced back into drain chamber 108 will be very small compared to the volume of liquid discharged through fluid path 122.

While the invention has been described in terms of a preferred embodiment, there are alterations, permutations, and equivalents which fall within the scope of this invention. It should also be noted that there are many alternative ways of implementing the methods and apparatuses of the present invention. It is therefore intended that the following claims be interpreted as including all such alterations, permutations and equivalents as fall within the true spirit and scope of the present invention.

What is claimed is:

1. A pump for pumping liquids under vacuum comprising:

a hollow cylinder, said cylinder having a first end and a second end;

a piston, said piston positioned within said cylinder for reciprocating movement therein and creating an annular seal with an interior surface of said cylinder;

a means of actuating said piston axially within said cylinder, said means of actuating being connected to said piston through said first end;

a cylinder head, said cylinder head having an upper surface and a lower surface and at least one side surface, said at least one side surface making up a thickness of said cylinder head between said upper surface and said lower surface, said cylinder head having a valve bore passing through said thickness, said cylinder head having a drain passage passing through said thickness parallel to said valve bore and adjacent to said valve bore, said lower surface of said cylinder head being sealably fixed to said second end of said cylinder, said cylinder head having an outlet port in said at least one side surface, said cylinder head having a discharge port in said lower surface, said cylinder head having a discharge passage connecting said discharge port to said outlet port such that fluid may pass through said cylinder head from said second end of said cylinder to said outlet port, said cylinder head having a valve seat in said lower surface, said valve seat circumscribing said valve bore and said drain passage but not circumscribing said discharge port;

a check valve, said check valve being fluidly coupled to said outlet port of said cylinder head, said check valve being oriented such that fluid may pass through said check valve in a direction from said discharge port to said outlet port, but many not pass in an opposite direction;

a drain chamber, said drain chamber being sealably fixed to said upper surface of said cylinder head, said drain chamber having an intake port to allow liquid to enter;

an inlet valve, said inlet valve having a stem of uniform cross section and one enlarged end, said inlet valve having an axial bore through its length, said stem of said inlet valve passing through said valve bore in said cylinder head and being axially movable therein, said inlet valve being oriented such that said enlarged end is toward said cylinder and said stem protrudes into said drain chamber, axial movement of said inlet valve being limited in one direction by said enlarged end encountering said valve seat;

a first stop, said first stop being rigidly fixed to an end of said stem of said inlet valve opposite to said enlarged end;

a compression spring, said compression spring being compressed between said first stop and said upper surface of said cylinder head;

a pull rod, said pull rod having a first end and a second end, said pull rod passing through said axial bore of said inlet valve such that it may move axially with respect to said inlet valve, said first end of said pull rod being affixed to said piston, said second end protruding into said drain chamber beyond the end of said stem of said inlet valve; and a second stop, said second stop being rigidly affixed to said second end of said pull rod;

wherein said means of actuating brings said piston into a fully retracted position away from said cylinder head, said piston then nearing said fully retracted position and said second stop pushing said stem of said inlet valve such that said compression spring is overcome and said inlet valve moves axially toward said piston such that space exists between said enlarged end of said inlet valve and said valve seat, said liquid entering said drain chamber through said intake port, said liquid then draining through said drain passage into said cylinder, said means of actuating then causing said piston to advance, said second stop ceasing to contact said stem of said inlet valve as said piston leaves said fully retracted position, said compression spring causing said inlet valve to move axially away from said piston such that said enlarged end pushes against said valve seat, thereby preventing said liquid from flowing back through said drain passage, and said liquid in said cylinder being forced through said discharge passage and through said check valve as said piston advances further.

2. The pump as disclosed in claim 1, wherein the pump is oriented such that said cylinder head is above said cylinder.

3. The pump as disclosed in claim 2, further comprising:

a liquid level sensor, said liquid level sensor being in fluid communication with said drain chamber, and a controller;

wherein said liquid fills said cylinder completely while said piston is in said fully retracted position, said liquid then continuing to partially fill said drain chamber until the level of said liquid reaches said liquid level sensor, said liquid level sensor then signaling said controller, said controller then producing a signal that results in said means of actuating advancing said piston.

4. The pump as disclosed in claim 3, wherein said liquid level sensor is a float switch.

5. The pump as disclosed in claim 4, further comprising:

a shaft seal, said shaft seal being housed in said axial bore through said inlet valve;

wherein said shaft seal creates an annular seal between the inlet valve and the surface of said pull rod, preventing the passage of fluid through said axial bore.

6. The pump as disclosed in claim 5, further comprising;

a plain bearing, said plain bearing being housed in said axial bore through said inlet valve, said pull rod passing through said plain bearing;

wherein said plain bearing provides a low friction surface to support said pull rod as it moves axially with respect to said inlet valve.

7. The pump as disclosed in claim 6, further comprising:

a valve slide block, said valve slide block having a bottom surface and a top surface, said top surface being pushed against by said compression spring and said bottom surface being affixed to said upper surface of said cylinder head, said valve slide block having a valve stem bore through which said stem of said inlet valve passes, the surface of said valve stem bore being made from a low-friction material to support said valve stem as it moves axially through said valve slide block, said bottom surface having reliefs cut therein;

wherein said reliefs permit fluids to pass between said drain chamber and said drain passage in said cylinder head.

8. The pump as disclosed in claim 7, wherein said means of actuating said piston is a pneumatic cylinder.

9. The pump as disclosed claim 8, further comprising:

a position sensor; said position sensor being a magnetic switch, the state of which changes when said pneumatic cylinder reaches or retreats from its extended position;

wherein said controller, receiving a signal from said position sensor, causes said pneumatic cylinder to assume its retracted position immediately following its having reached its fully extended position.

10. The pump as disclosed in claim 9, wherein during the advancing stroke of said piston, the quantity of said liquid forced out of said cylinder and through said check valve is 20 times the quantity of said liquid forced out of said cylinder back through said cylinder head into said drain chamber.

* * * * *